US009759096B2

(12) United States Patent
Vermeersch

(10) Patent No.: US 9,759,096 B2
(45) Date of Patent: Sep. 12, 2017

(54) SUPERCRITICAL WORKING FLUID CIRCUIT WITH A TURBO PUMP AND A START PUMP IN SERIES CONFIGURATION

(71) Applicant: Michael Louis Vermeersch, Hamilton, OH (US)

(72) Inventor: Michael Louis Vermeersch, Hamilton, OH (US)

(73) Assignee: Echogen Power Systems, L.L.C., Akron, OH (US)

( * ) Notice: Subject to any disclaimer, the term of this patent is extended or adjusted under 35 U.S.C. 154(b) by 143 days.

(21) Appl. No.: 14/801,153

(22) Filed: Jul. 16, 2015

(65) Prior Publication Data

US 2015/0345339 A1 Dec. 3, 2015

Related U.S. Application Data

(62) Division of application No. 13/969,738, filed on Aug. 19, 2013, now Pat. No. 9,091,278.

(60) Provisional application No. 61/684,933, filed on Aug. 20, 2012.

(51) Int. Cl.

| | |
|---|---|
| ***F01K 7/16*** | (2006.01) |
| ***F01K 13/02*** | (2006.01) |
| ***F01K 25/10*** | (2006.01) |
| ***F04D 29/58*** | (2006.01) |
| ***F01K 3/18*** | (2006.01) |
| ***F01K 7/32*** | (2006.01) |

(52) U.S. Cl.

CPC ..... *F01K 7/165* (2013.01); *F01K 3/185* (2013.01); *F01K 7/32* (2013.01); *F01K 13/02* (2013.01); *F01K 25/103* (2013.01); *F04D 29/58* (2013.01)

(58) Field of Classification Search

CPC . F01K 7/165; F01K 13/02; F01K 7/32; F01K 3/185; F01K 25/103; F04D 29/58

USPC ..... 60/646, 657, 660, 651, 671

See application file for complete search history.

(56) References Cited

U.S. PATENT DOCUMENTS

| | | | | |
|---|---|---|---|---|
| 5,694,764 | A * | 12/1997 | Blain | F02C 7/26 60/734 |
| 7,950,230 | B2 * | 5/2011 | Nishikawa | F01K 13/02 60/618 |
| 9,091,278 | B2 * | 7/2015 | Vermeersch | F04D 29/58 |
| 2004/0020206 | A1 * | 2/2004 | Sullivan | F01C 1/0215 60/670 |

* cited by examiner

*Primary Examiner* — Hoang Nguyen

(57) ABSTRACT

Aspects of the invention provided herein include heat engine systems, methods for generating electricity, and methods for starting a turbo pump. In some configurations, the heat engine system contains a start pump and a turbo pump disposed in series along a working fluid circuit and configured to circulate a working fluid within the working fluid circuit. The start pump may have a pump portion coupled to a motor-driven portion and the turbo pump may have a pump portion coupled to a drive turbine. In one configuration, the pump portion of the start pump is fluidly coupled to the working fluid circuit downstream of and in series with the pump portion of the turbo pump. In another configuration, the pump portion of the start pump is fluidly coupled to the working fluid circuit upstream of and in series with the pump portion of the turbo pump.

12 Claims, 7 Drawing Sheets

SUPERCRITICAL WORKING FLUID CIRCUIT WITH A TURBO PUMP AND A START PUMP IN SERIES CONFIGURATION

CROSS-REFERENCE TO RELATED APPLICATIONS

This application is a divisional application of U.S. application Ser. No. 13/969,738, filed Aug. 19, 2013, which claims the benefit of U.S. Appl. No. 61/684,933, filed Aug. 20, 2012. Each patent application identified above is incorporated herein by reference in its entirety, to the extent consistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine cycles. Rankine cycles and similar thermodynamic methods are typically steam-based processes that recover and utilize waste heat to generate steam for driving a turbine, turbo, or other expander connected to an electric generator, a pump, or other device.

An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

A pump or compressor is generally required to pressurize and circulate the working fluid throughout the working fluid circuit. The pump is typically a motor-driven pump, however, such pumps require costly shaft seals to prevent working fluid leakage and often require the implementation of a gearbox and a variable frequency drive, which add to the overall cost and complexity of the system. A turbo pump is a device that utilizes a drive turbine to power a rotodynamic pump. Replacing the motor-driven pump with a turbo pump eliminates one or more of these issues, but at the same time introduces problems of starting and achieving steady-state operation the turbo pump, which relies on the circulation of heated working fluid through the drive turbine for proper operation. Unless the turbo pump is provided with a successful start sequence, the turbo pump will not be able to circulate enough fluid to properly function and attain steady-state operation.

What is needed, therefore, is a heat engine system and method of operating a waste heat recovery thermodynamic cycle that provides a successful start sequence adapted to start a turbo pump and reach a steady-state of operating the system with the turbo pump.

SUMMARY

Embodiments of the invention generally provide a heat engine system and a method for generating electricity. In some embodiments, the heat engine system contains a start pump and a turbo pump disposed in series along a working fluid circuit and configured to circulate a working fluid within the working fluid circuit. The start pump may have a pump portion coupled to a motor-driven portion (e.g., mechanical or electric motor) and the turbo pump may have a pump portion coupled to a drive turbine. In one embodiment, the pump portion of the start pump is fluidly coupled to the working fluid circuit downstream of and in series with the pump portion of the turbo pump. In another embodiment, the pump portion of the start pump is fluidly coupled to the working fluid circuit upstream of and in series with the pump portion of the turbo pump.

The heat engine system and the method for generating electricity are configured to efficiently generate valuable electrical energy from thermal energy, such as a heated stream (e.g., a waste heat stream). The heat engine system utilizes a working fluid in a supercritical state (e.g., sc-$CO_2$) and/or a subcritical state (e.g., sub-$CO_2$) contained within a working fluid circuit for capturing or otherwise absorbing thermal energy of the waste heat stream with one or more heat exchangers. The thermal energy is transformed to mechanical energy by a power turbine and subsequently transformed to electrical energy by the power generator coupled to the power turbine. The heat engine system contains several integrated sub-systems managed by a process control system for maximizing the efficiency of the heat engine system while generating electricity.

In one embodiment disclosed herein, a heat engine system for generating electricity contains a turbo pump having a pump portion operatively coupled to a drive turbine, such that the pump portion may be fluidly coupled to a working fluid circuit and configured to circulate a working fluid through the working fluid circuit and the working fluid has a first mass flow and a second mass flow within the working fluid circuit. The heat engine system further contains a first heat exchanger fluidly coupled to and in thermal communication with the working fluid circuit, fluidly coupled to and in thermal communication with a heat source stream, and configured to transfer thermal energy from the heat source stream to the first mass flow of the working fluid. The heat engine system also contains a power turbine fluidly coupled to and in thermal communication with the working fluid circuit, disposed downstream of the first heat exchanger, and configured to convert thermal energy to mechanical energy by a pressure drop in the first mass flow of the working fluid flowing through the power turbine and a power generator coupled to the power turbine and configured to convert the mechanical energy into electrical energy. The heat engine system further contains a start pump having a pump portion operatively coupled to a motor and configured to circulate the working fluid within the working fluid circuit, such that the pump portion of the start pump and the pump portion of the turbo pump are fluidly coupled in series to the working fluid circuit.

In one exemplary configuration, the pump portion of the start pump is fluidly coupled to the working fluid circuit downstream of and in series with the pump portion of the turbo pump. Therefore, an outlet of the pump portion of the turbo pump may be fluidly coupled to and serially upstream of an inlet of the pump portion of the start pump. In another exemplary configuration, the pump portion of the start pump is fluidly coupled to the working fluid circuit upstream of and in series with the pump portion of the turbo pump. Therefore, an inlet of the pump portion of the turbo pump may be fluidly coupled to and serially downstream of an outlet of the pump portion of the start pump.

In some embodiments, the heat engine system further contains a first recuperator fluidly coupled to the power turbine and configured to receive the first mass flow discharged from the power turbine and a second recuperator fluidly coupled to the drive turbine, the drive turbine being configured to receive and expand the second mass flow and discharge the second mass flow into the second recuperator. In some examples, the first recuperator may be configured to transfer residual thermal energy from the first mass flow to the second mass flow before the second mass flow is expanded in the drive turbine. The first recuperator may be configured to transfer residual thermal energy from the first mass flow discharged from the power turbine to the first mass flow directed to the first heat exchanger. The second recuperator may be configured to transfer residual thermal energy from the second mass flow discharged from the drive turbine to the second mass flow directed to a second heat exchanger.

In some embodiments, the heat engine system further contains a second heat exchanger fluidly coupled to and in thermal communication with the working fluid circuit, disposed in series with the first heat exchanger along the working fluid circuit, fluidly coupled to and in thermal communication with the heat source stream, and configured to transfer thermal energy from the heat source stream to the second mass flow of the working fluid. The second heat exchanger may be in thermal communication with the heat source stream and in fluid communication with the pump portion of the turbo pump and the pump portion of the start pump. In many examples described herein, the working fluid contains carbon dioxide and at least a portion of the working fluid circuit contains the working fluid in a supercritical state.

In another embodiment, the heat engine system further contains a first recirculation line fluidly coupling the pump portion of the turbo pump with a low pressure side of the working fluid circuit, a second recirculation line fluidly coupling the pump portion of the start pump with the low pressure side of the working fluid circuit, a first bypass valve arranged in the first recirculation line, and a second bypass valve arranged in the second recirculation line.

In other embodiments disclosed herein, a heat engine system for generating electricity contains a turbo pump configured to circulate a working fluid throughout the working fluid circuit and contains a pump portion operatively coupled to a drive turbine. In some examples, the turbo pump is hermetically-sealed within a casing. The heat engine system also contains a start pump arranged in series with the turbo pump along the working fluid circuit. The heat engine system further contains a first check valve arranged in the working fluid circuit downstream of the pump portion of the turbo pump, and a second check valve arranged in the working fluid circuit downstream of the pump portion of the start pump and fluidly coupled to the first check valve.

The heat engine system further contains a power turbine fluidly coupled to both the pump portion of the turbo pump and the pump portion of the start pump, a first recirculation line fluidly coupling the pump portion of the turbo pump with a low pressure side of the working fluid circuit, and a second recirculation line fluidly coupling the pump portion of the start pump with the low pressure side of the working fluid circuit. In some configurations, the heat engine system contains a first recuperator fluidly coupled to the power turbine and a second recuperator fluidly coupled to the drive turbine. In some examples, the heat engine system contains a third recuperator fluidly coupled to the second recuperator, wherein the first, second, and third recuperators are disposed in series along the working fluid circuit.

The heat engine system further contains a condenser fluidly coupled to both the pump portion of the turbo pump and the pump portion of the start pump. Also, the heat engine system further contains first, second, and third heat exchangers disposed in series and in thermal communication with a heat source stream and disposed in series and in thermal communication with the working fluid circuit.

In other embodiments disclosed herein, a method for starting a turbo pump in a heat engine system and/or generating electricity with the heat engine system is provided and includes circulating a working fluid within a working fluid circuit by a start pump and transferring thermal energy from a heat source stream to the working fluid by a first heat exchanger fluidly coupled to and in thermal communication with the working fluid circuit. Generally, the working fluid has a first mass flow and a second mass flow within the working fluid circuit and at least a portion of the working fluid circuit contains the working fluid in a supercritical state. The method further includes flowing the working fluid into a drive turbine of a turbo pump and expanding the working fluid while converting the thermal energy from the working fluid to mechanical energy of the drive turbine and driving a pump portion of the turbo pump by the mechanical energy of the drive turbine. The pump portion may be coupled to the drive turbine and the working fluid may be circulated within the working fluid circuit by the turbo pump. The method also includes diverting the working fluid discharged from the pump portion of the turbo pump into a first recirculation line fluidly communicating the pump portion of the turbo pump with a low pressure side of the working fluid circuit and closing a first bypass valve arranged in the first recirculation line as the turbo pump reaches a self-sustaining speed of operation. The method further includes deactivating the start pump and opening a second bypass valve arranged in a second recirculation line fluidly communicating the start pump with the low pressure side of the working fluid circuit, and diverting the working fluid discharged from the start pump into the second recirculation line. Also, the method includes flowing the working fluid into a power turbine and converting the thermal energy from the working fluid to mechanical energy of the power turbine and converting the mechanical energy of the power turbine into electrical energy by a power generator coupled to the power turbine.

In some embodiments, the method includes circulating the working fluid in the working fluid circuit with the start pump is preceded by closing a shut-off valve to divert the working fluid around a power turbine arranged in the working fluid circuit. In other embodiments, the method further includes opening the shut-off valve once the turbo pump reaches the self-sustaining speed of operation, thereby directing the working fluid into the power turbine, expanding the working fluid in the power turbine, and driving a power generator operatively coupled to the power turbine to generate electrical power. In other embodiments, the method further includes opening the shut-off valve once the turbo pump reaches the self-sustaining speed of operation, directing the working fluid into a second heat exchanger fluidly coupled to the power turbine and in thermal communication with the heat source stream, transferring additional thermal energy from the heat source stream to the working fluid in the second heat exchanger, expanding the working fluid received from the second heat exchanger in the power turbine, and driving a power generator operatively coupled to the power turbine, whereby the power generator is operable to generate electrical power.

In some embodiments, the method also includes opening the shut-off valve once the turbo pump reaches the self-sustaining speed of operation, directing the working fluid into a second heat exchanger in thermal communication with the heat source stream, the first and second heat exchangers being arranged in series in the heat source stream, directing the working fluid from the second heat exchanger into a third heat exchanger fluidly coupled to the power turbine and in thermal communication with the heat source stream, the first, second, and third heat exchangers being arranged in series in the heat source stream, transferring additional thermal energy from the heat source stream to the working fluid in the third heat exchanger, expanding the working fluid received from the third heat exchanger in the power turbine, and driving a power generator operatively coupled to the power turbine, whereby the power generator is operable to generate electrical power.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
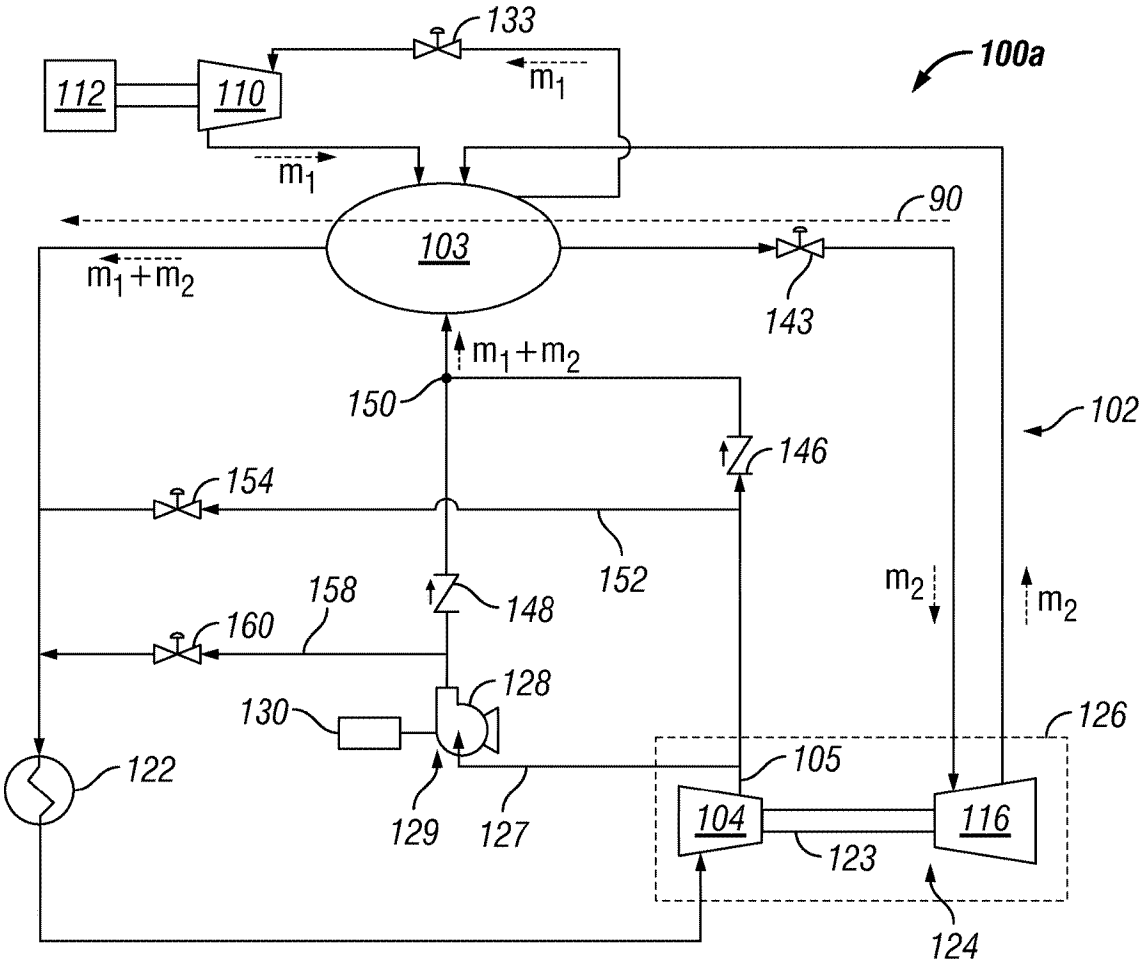
FIG. 1A illustrates a schematic of a heat engine system, according to one or more embodiments disclosed herein.
Figure 1B:
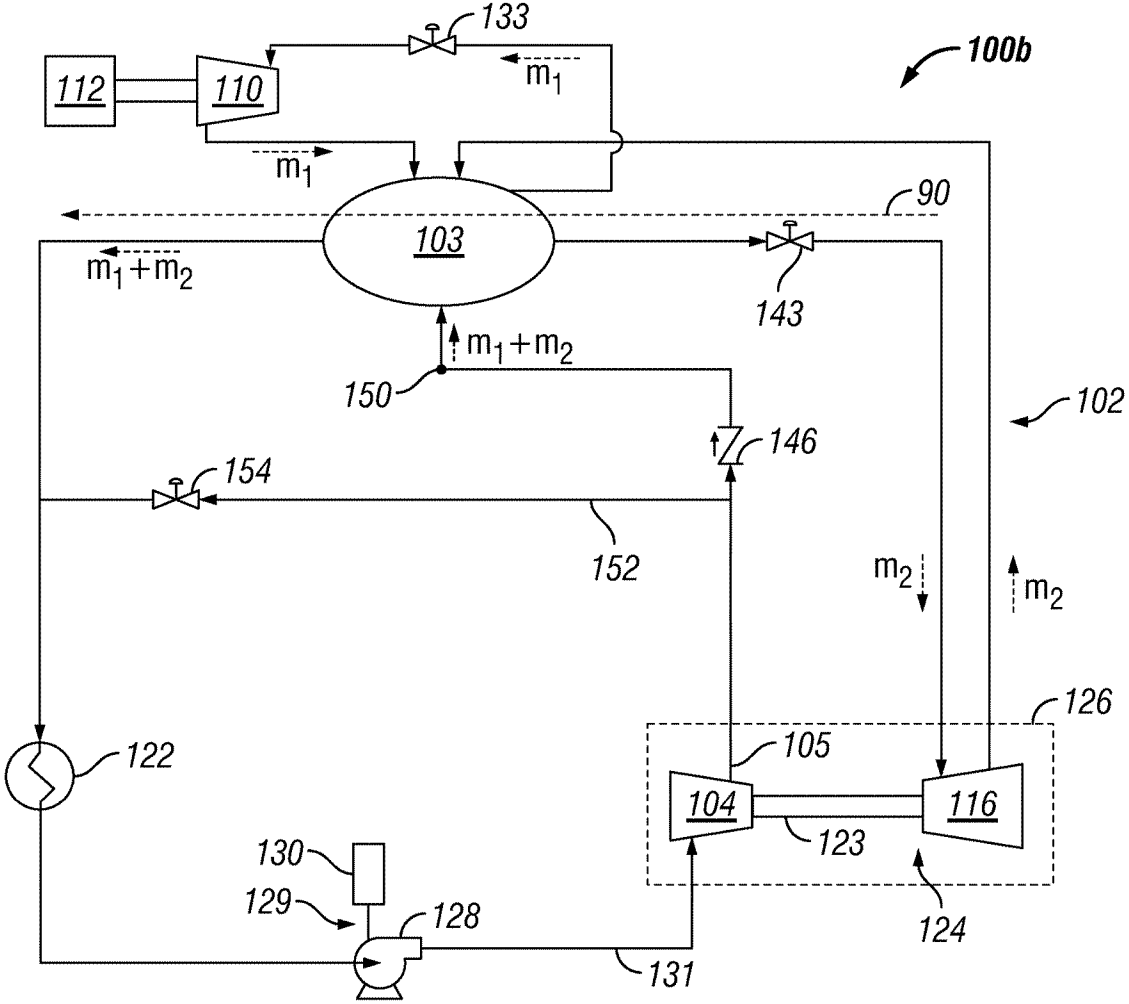
FIG. 1B illustrates a schematic of another heat engine system, according to one or more embodiments disclosed herein.

FIGS. 1A and 1B depict simplified schematics of heat engine systems 100*a* and 100*b*, respectively, which may also be referred to as thermal heat engines, power generation devices, heat recovery systems, and/or heat to electricity systems. Heat engine systems 100*a* and 100*b* may encompass one or more elements of a Rankine thermodynamic cycle configured to produce power (e.g., electricity) from a wide range of thermal sources. The terms "thermal engine" or "heat engine" as used herein generally refer to an equipment set that executes the various thermodynamic cycle embodiments described herein. The term "heat recovery system" generally refers to the thermal engine in cooperation with other equipment to deliver/remove heat to and from the thermal engine.

Heat engine systems 100*a* and 100*b* generally have at least one heat exchanger 103 and a power turbine 110 fluidly coupled to and in thermal communication with a working fluid circuit 102 containing a working fluid. In some configurations, the heat engine systems 100*a* and 100*b* contain a single heat exchanger 103. However, in other configurations, the heat engine systems 100*a* and 100*b* contain two, three, or more heat exchangers 103 fluidly coupled to the working fluid circuit 102 and configured to be fluidly coupled to a heat source stream 90 (e.g., waste heat stream flowing from a waste heat source). The power turbine 110 may be any type of expansion device, such as an expander or a turbine, and may be operatively coupled to an alternator, a power generator 112, or other device or system configured to receive shaft work produced by the power turbine 110 and generate electricity. The power turbine 110 has an inlet for receiving the working fluid flowing through a control valve 133 from the heat exchangers 103 in the high pressure side of the working fluid circuit 102. The power turbine 110 also has an outlet for releasing the working fluid into the low pressure side of the working fluid circuit 102. The control valve 133 may be operatively configured to control the flow of working fluid from the heat exchangers 103 to an inlet of the power turbine 110.

The heat engine systems 100*a* and 100*b* further contain several pumps, such as a turbo pump 124 and a start pump 129, disposed within the working fluid circuit 102. Each of the turbo pump 124 and the start pump 129 is fluidly coupled between the low pressure side and the high pressure side of the working fluid circuit 102. Specifically, a pump portion 104 and a drive turbine 116 of the turbo pump 124 and a pump portion 128 of the start pump 129 are each fluidly coupled independently between the low pressure side and the high pressure side of the working fluid circuit 102. The turbo pump 124 and the start pump 129 may be operative to circulate and pressurize the working fluid throughout the working fluid circuit 102. The start pump 129 may be utilized to initially pressurize and circulate the working fluid in the working fluid circuit 102. Once a predetermined pressure, temperature, and/or flowrate of the working fluid is obtained within the working fluid circuit 102, the start pump 129 may be taken off line, idled, or turned off and the turbo pump 124 utilized to circulate the working fluid while generating electricity.

FIGS. 1A and 1B depict the turbo pump 124 and the start pump 129 fluidly coupled in series to the working fluid circuit 102, such that the pump portion 104 of the turbo pump 124 and the pump portion 128 of the start pump 129 are fluidly coupled in series to the working fluid circuit 102. In one embodiment, FIG. 1A depicts the pump portion 104 of the turbo pump 124 fluidly coupled upstream of the pump portion 128 of the start pump 129, such that the working fluid may flow from the condenser 122, through the pump portion 104 of the turbo pump 124, then serially through the pump portion 128 of the start pump 129, and subsequently to the power turbine 110. In another embodiment, FIG. 1B depicts the pump portion 128 of the start pump 129 fluidly coupled upstream of the pump portion 104 of the turbo pump 124, such that the working fluid may flow from the condenser 122, through the pump portion 128 of the start pump 129, then serially through the pump portion 104 of the turbo pump 124, and subsequently to the power turbine 110.

The start pump 129 may be a motorized pump, such as an electric motorized pump, a mechanical motorized pump, or other type of pump. Generally, the start pump 129 may be a variable frequency motorized drive pump and contains the pump portion 128 and a motor-driven portion 130. The motor-driven portion 130 of the start pump 129 contains a motor and a drive including a drive shaft and optional gears (not shown). In some examples, the motor-driven portion 130 has a variable frequency drive, such that the speed of the motor may be regulated by the drive. The motor-driven portion 130 may be powered by an external electric source.

The pump portion 128 of the start pump 129 may be driven by the motor-driven portion 130 coupled thereto. In one embodiment, as depicted in FIG. 1A, the pump portion 128 of the start pump 129 has an inlet for receiving the working fluid from an outlet of the pump portion 104 of the turbo pump 124. The pump portion 128 of the start pump 129 also has an outlet for releasing the working fluid into the working fluid circuit 102 upstream of the power turbine 110. In another embodiment, as depicted in FIG. 1B, the pump portion 128 of the start pump 129 has an inlet for receiving the working fluid from the low pressure side of the working fluid circuit 102, such as from the condenser 122. The pump portion 128 of the start pump 129 also has an outlet for releasing the working fluid into the working fluid circuit 102 upstream of the pump portion 104 of the turbo pump 124.

The turbo pump 124 is generally a turbo/turbine-driven pump or compressor and utilized to pressurize and circulate the working fluid throughout the working fluid circuit 102. The turbo pump 124 contains the pump portion 104 and the drive turbine 116 coupled together by a drive shaft 123 and optional gearbox. The pump portion 104 of the turbo pump 124 may be driven by the drive shaft 123 coupled to the drive turbine 116.

The drive turbine 116 of the turbo pump 124 may be any type of expansion device, such as an expander or a turbine, and may be operatively coupled to the pump portion 104, or other compressor/pump device configured to receive shaft work produced by the drive turbine 116. The drive turbine 116 may be driven by heated and pressurized working fluid, such as the working fluid heated by the heat exchangers 103. The drive turbine 116 has an inlet for receiving the working fluid flowing through a control valve 143 from the heat exchangers 103 in the high pressure side of the working fluid circuit 102. The drive turbine 116 also has an outlet for releasing the working fluid into the low pressure side of the working fluid circuit 102. The control valve 143 may be operatively configured to control the flow of working fluid from the heat exchangers 103 to the inlet of the drive turbine 116.

In one embodiment, as depicted in FIG. 1A, the pump portion 104 of the turbo pump 124 has an inlet configured to receive the working fluid from the low pressure side of the working fluid circuit 102, such as downstream of the condenser 122. The pump portion 104 of the turbo pump 124 has an outlet for releasing the working fluid into the working fluid circuit 102 upstream of the pump portion 128 of the start pump 129. In addition, the pump portion 128 of the start pump 129 has an inlet configured to receive the working fluid from an outlet of the pump portion 104 of the turbo pump 124.

In another embodiment, as depicted in FIG. 1B, the pump portion 128 of the start pump 129 has an inlet configured to receive the working fluid from the low pressure side of the working fluid circuit 102, such as downstream of the condenser 122. The pump portion 128 of the start pump 129 has an outlet for releasing the working fluid into the working fluid circuit 102 upstream of the pump portion 104 of the turbo pump 124. Also, the pump portion 104 of the turbo pump 124 has an inlet configured to receive the working fluid from an outlet of the pump portion 128 of the start pump 129.

The pump portion 128 of the start pump 129 is configured to circulate and/or pressurize the working fluid within the working fluid circuit 102 during a warm-up process. The pump portion 128 of the start pump 129 is configured in series with the pump portion 104 of the turbo pump 124. In one example, illustrated in FIG. 1A, the heat engine system 100*a* has a suction line 127 fluidly coupled to and disposed between the discharge line 105 of the pump portion 104 and the pump portion 128. The suction line 127 provides flow from the pump portion 104 and the pump portion 128. In another example, illustrated in FIG. 1B, the heat engine system 100*b* has a line 131 fluidly coupled to and disposed between the pump portion 104 and the pump portion 128. The line 131 provides flow from the pump portion 104 and the pump portion 128. Start pump 129 may operate until the mass flow rate and temperature of the second mass flow $m_2$ is sufficient to operate the turbo pump 124 in a self-sustaining mode.

In one embodiment, the turbo pump 124 is hermetically-sealed within housing or casing 126 such that shaft seals are not needed along the drive shaft 123 between the pump portion 104 and drive turbine 116. Eliminating shaft seals may be advantageous since it contributes to a decrease in capital costs for the heat engine system 100*a* or 100*b*. Also, hermetically-sealing the turbo pump 124 with the casing 126 presents significant savings by eliminating overboard working fluid leakage. In other embodiments, however, the turbo pump 124 need not be hermetically-sealed.

In one or more embodiments, the working fluid within the working fluid circuit 102 of the heat engine system 100*a* or 100*b* contains carbon dioxide. It should be noted that use of the term carbon dioxide is not intended to be limited to carbon dioxide of any particular type, purity, or grade. For example, industrial grade carbon dioxide may be used without departing from the scope of the disclosure. In other embodiments, the working fluid may a binary, ternary, or other working fluid blend. For example, a working fluid combination can be selected for the unique attributes possessed by the combination within a heat recovery system, as described herein. One such fluid combination includes a liquid absorbent and carbon dioxide mixture enabling the combination to be pumped in a liquid state to high pressure with less energy input than required to compress carbon dioxide. In other embodiments, the working fluid may be a combination of carbon dioxide and one or more other miscible fluids. In yet other embodiments, the working fluid may be a combination of carbon dioxide and propane, or carbon dioxide and ammonia, without departing from the scope of the disclosure.

The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the working fluid circuit 102, the heat engine systems 100*a* or 100*b*, or thermodynamic cycle. In one or more embodiments, the working fluid may be in a supercritical state over certain portions of the working fluid circuit 102 (e.g., a high pressure side), and may be in a supercritical state or a subcritical state at other portions the working fluid circuit 102 (e.g., a low pressure side). In other embodiments, the entire thermodynamic cycle may be operated such that the working fluid is maintained in either a supercritical or subcritical state throughout the entire working fluid circuit 102.

In a combined state, and as will be used herein, the working fluid may be characterized as $m_1+m_2$, where $m_1$ is a first mass flow and $m_2$ is a second mass flow, but where each mass flow $m_1$, $m_2$ is part of the same working fluid mass being circulated throughout the working fluid circuit 102. The combined working fluids $m_1+m_2$ from pump portion 104 of the turbo pump 124 are directed to the heat exchangers 103. The first mass flow $m_1$ is directed to power turbine 110 to drive power generator 112. The second mass flow $m_2$ is directed from the heat exchangers 102 back to the drive turbine 116 of the turbo pump 124 to provide the energy needed to drive the pump portion 104. After passing through the power turbine 110 and the drive turbine 116, the first and second mass flows are combined and directed to the condenser 122 and back to the turbo pump 124 and the cycle is started anew.

Steady-state operation of the turbo pump 124 is at least partially dependent on the mass flow and temperature of the second mass flow $m_2$ expanded within the drive turbine 116. Until the mass flow rate and temperature of the second mass flow $m_2$ is sufficiently increased, the drive turbine 116 cannot adequately drive the pump portion 104 in self-sustaining operation. Accordingly, at start-up of the heat engine system 100*a*, and until the turbo pump 124 "ramps-up" and is able to adequately circulate the working fluid, the heat engine system 100*a* or 100*b* utilizes a start pump 129 to circulate the working fluid within the working fluid circuit 102.

To facilitate the start sequence of the turbo pump 124, heat engine systems 100*a* and 100*b* may further include a series of check valves, bypass valves, and/or shut-off valves arranged at predetermined locations throughout the working fluid circuit 102. These valves may work in concert to direct the working fluid into the appropriate conduits until steady-state operation of turbo pump 124 can be maintained. In one or more embodiments, the various valves may be automated or semi-automated motor-driven valves coupled to an automated control system (not shown). In other embodiments, the valves may be manually-adjustable or may be a combination of automated and manually-adjustable.

FIG. 1A depicts a first check valve 146 arranged downstream of the pump portion 104 and a second check valve 148 arranged downstream of the pump portion 128, as described in one embodiment. FIG. 1B depicts the first check valve 146 arranged downstream of the pump portion 104, as described in one embodiment. The check valves 146, 148 may be configured to prevent the working fluid from flowing upstream ofward the respective pump portions 104, 128 during various stages of operation of the heat engine system 100*a*. For instance, during start-up and ramp-up of the heat engine system 100*a*, the start pump 129 creates an elevated head pressure downstream of the first check valve 146 (e.g., at point 150) as compared to the low pressure at discharge line 105 of the pump portion 104 and the suction line 127 of the pump portion 128, as depicted in FIG. 1A. Thus, the first check valve 146 prevents the high pressure working fluid discharged from the pump portion 128 from re-circulating toward the pump portion 104 and ensures that the working fluid flows into heat exchangers 103.

Until the turbo pump 124 accelerates past the stall speed of the turbo pump 124, where the pump portion 104 can adequately pump against the head pressure created by the start pump 129, a first recirculation line 152 may be used to divert a portion of the low pressure working fluid discharged from the pump portion 104. A first bypass valve 154 may be arranged in the first recirculation line 152 and may be fully or partially opened while the turbo pump 124 ramps up or otherwise increases speed to allow the low pressure working fluid to recirculate back to the working fluid circuit 102, such as any point in the working fluid circuit 102 downstream of the heat exchangers 103 and before the pump portions 104, 128. In one embodiment, the first recirculation line 152 may fluidly couple the discharge of the pump portion 104 to the inlet of the condenser 122.

Once the turbo pump 124 attains a self-sustaining speed, the bypass valve 154 in the first recirculation line 152 can be gradually closed. Gradually closing the bypass valve 154 will increase the fluid pressure at the discharge from the pump portion 104 and decrease the flow rate through the first recirculation line 152. Eventually, once the turbo pump 124 reaches steady-state operating speeds, the bypass valve 154 may be fully closed and the entirety of the working fluid discharged from the pump portion 104 may be directed through the first check valve 146. Also, once steady-state operating speeds are achieved, the start pump 129 becomes redundant and can therefore be deactivated. The heat engine systems 100*a* and 100*b* may have an automated control system (not shown) configured to regulate, operate, or otherwise control the valves and other components therein.

In another embodiment, as depicted in FIG. 1A, to facilitate the deactivation of the start pump 129 without causing damage to the start pump 129, a second recirculation line 158 having a second bypass valve 160 is arranged therein may direct lower pressure working fluid discharged from the pump portion 128 to a low pressure side of the working fluid circuit 102 in the heat engine system 100*a*. The low pressure side of the working fluid circuit 102 may be any point in the working fluid circuit 102 downstream of the heat exchangers 103 and before the pump portions 104, 128. The second bypass valve 160 is generally closed during start-up and ramp-up so as to direct all the working fluid discharged from the pump portion 128 through the second check valve 148. However, as the start pump 129 powers down, the head pressure past the second check valve 148 becomes greater than the pump portion 128 discharge pressure. In order to provide relief to the pump portion 128, the second bypass valve 160 may be gradually opened to allow working fluid to escape to the low pressure side of the working fluid circuit. Eventually the second bypass valve 160 may be completely opened as the speed of the pump portion 128 slows to a stop.

Connecting the start pump 129 in series with the turbo pump 124 allows the pressure generated by the start pump 129 to act cumulatively with the pressure generated by the turbo pump 124 until self-sustaining conditions are achieved. When compared to a start pump connected in parallel with a turbo pump, the start pump 129 connected in series supplies the same flow rate but at a much lower pressure differential. The start pump 129 does not have to generate as much pressure differential as the turbo pump 124. Therefore, the power requirement to operate the pump portion 128 is reduced such that a smaller motor-driven portion 130 may be utilized to operate the pump portion 128.

In some embodiments disclosed herein, the start pump 129 and the turbo pump 124 may be fluidly coupled in series along the working fluid circuit 202, whereas the pump portion 104 of the turbo pump 124 is disposed upstream of the pump portion 128 of the start pump 129, as depicted in FIG. 1A. Such serial configuration of the turbo pump 124 and the start pump 129 provides a reduction of the power demand for the start pump 129 by efficiently increasing the pressure within the working fluid circuit 102 while self-sustaining the turbo pump 124 during a warm-up or start-up process.

In other embodiments disclosed herein, the start pump 129 and the turbo pump 124 are fluidly coupled in series along the working fluid circuit 202, whereas the pump portion 128 of the start pump 129 is disposed upstream of the pump portion 104 of the turbo pump 124, as depicted in FIG. 1B. Such serial configuration of the start pump 129 and the turbo pump 124 provides a reduction of the pressure demand for the start pump 129. Therefore, the start pump 129 may also function as a low speed booster pump to mitigate risk of cavitation to the turbo pump 124. The functionality of a low speed booster pump enables higher cycle power by operating closer to saturation without cavitation thus increasing the turbine pressure ratio.

In one or more embodiments disclosed herein, both of the heat engine systems 100*a* (FIG. 1A) and the heat engine system 100*b* (FIG. 1B) contain the turbo pump 124 having the pump portion 104 operatively coupled to the drive turbine 116, such that the pump portion 104 is fluidly coupled to the working fluid circuit 102 and configured to circulate a working fluid through the working fluid circuit 102. The working fluid may have a first mass flow, $m_1$, and a second mass flow, $m_2$, within the working fluid circuit 102. The heat engine systems 100*a* and 100*b* may have one, two, three, or more heat exchangers 103 fluidly coupled to and in thermal communication with the working fluid circuit 102, fluidly coupled to and in thermal communication with the heat source stream 90 (e.g., waste heat stream flowing from a waste heat source), and configured to transfer thermal energy from the heat source stream 90 to the first mass flow of the working fluid within the working fluid circuit 102. The heat engine systems 100*a* and 100*b* also have the power generator 112 coupled to the power turbine 110. The power turbine 110 is fluidly coupled to and in thermal communication with the working fluid circuit 102 and disposed downstream of the first heat exchanger 103. The power turbine 110 is generally configured to convert thermal energy to mechanical energy by a pressure drop in the first mass flow of the working fluid flowing through the power turbine 110. The power generator 112 may be substituted with an alternator other device configured to convert the mechanical energy into electrical energy.

The heat engine systems 100*a* and 100*b* further contain the start pump 129 having the pump portion 128 operatively coupled to the motor-driven portion 130 and configured to circulate the working fluid within the working fluid circuit 102. For example, the pump portion 128 of the start pump 129 and the pump portion 104 of the turbo pump 124 may be fluidly coupled in series to the working fluid circuit 102.

In one exemplary configuration, as depicted in FIG. 1A, the pump portion 128 of the start pump 129 is fluidly coupled to the working fluid circuit 102 downstream of and in series with the pump portion 104 of the turbo pump 124. Therefore, the heat engine system 100*a* has an outlet of the pump portion 104 of the turbo pump 124 that may be fluidly coupled to and serially upstream of an inlet of the pump portion 128 of the start pump 129. In another exemplary configuration, as depicted in FIG. 1B, the pump portion 128 of the start pump 129 is fluidly coupled to the working fluid circuit 102 upstream of and in series with the pump portion 104 of the turbo pump 124. Therefore, the heat engine system 100*b* has an inlet of the pump portion 104 of the turbo pump 124 that may be fluidly coupled to and serially downstream of an outlet of the pump portion 128 of the start pump 129.

In some embodiments, the heat engine systems 100*a* and 100*b* further contain a first recuperator or condenser, such as condenser 122, fluidly coupled to the power turbine 110 and configured to receive the first mass flow discharged from the power turbine 110. The heat engine systems 100*a* and 100*b* may also contain a second recuperator or condenser (not shown) fluidly coupled to the drive turbine 116, such that the drive turbine 116 may be configured to receive and expand the second mass flow and discharge the second mass flow into the additional recuperator or condenser. In some examples, the recuperator or condenser 122 may be configured to transfer residual thermal energy from the first mass flow to the second mass flow before the second mass flow is expanded in the drive turbine 116. The recuperator or condenser 122 may be configured to transfer residual thermal energy from the first mass flow discharged from the power turbine 110 to the first mass flow directed to the first heat exchanger 103. The additional recuperator or condenser may be configured to transfer residual thermal energy from the second mass flow discharged from the drive turbine 116 to the second mass flow directed to a second heat exchanger, such as contained within the first heat exchanger 103.

In some embodiments, the heat engine system 100*a* and 100*b* further contain a second heat exchanger 103 fluidly coupled to and in thermal communication with the working fluid circuit 102 and disposed in series with the first heat exchanger 103 along the working fluid circuit 102. The second heat exchanger 103 may be fluidly coupled to and in thermal communication with the heat source stream 90 and configured to transfer thermal energy from the heat source stream 90 to the second mass flow of the working fluid. The second heat exchanger 103 may be in thermal communication with the heat source stream 90 and in fluid communication with the pump portion 104 of the turbo pump 124 and the pump portion 128 of the start pump 129. In some embodiments described herein, the heat engine system 100*a* or 100*b* contains first, second, and third heat exchangers, such as the heat exchangers 103, disposed in series and in thermal communication with the heat source stream 90 by the working fluid within the working fluid circuit 102. Also, the heat exchangers 103 may be disposed in series, parallel, or a combination thereof and in thermal communication by the working fluid within the working fluid circuit 102. In many examples described herein, the working fluid contains carbon dioxide and at least a portion of the working fluid circuit 102, such as the high pressure side, contains the working fluid in a supercritical state.

In another embodiment, the heat engine systems 100*a* and 100*b* further contain a first recirculation line 152 and a first bypass valve 154 disposed therein. The first recirculation line 152 may be fluidly coupled to the pump portion 104 of the turbo pump 124 on the low pressure side of the working fluid circuit 102. Also, the heat engine system 100*a* has a second recirculation line 158 and a second bypass valve 160 disposed therein, as depicted in FIG. 1A. The second recirculation line 158 may be fluidly coupled to the pump portion 128 of the start pump 129 on the low pressure side of the working fluid circuit 102.

In other embodiments disclosed herein, the heat engine systems 100*a* and 100*b* contain the turbo pump 124 configured to circulate a working fluid throughout the working fluid circuit 102 and the pump portion 104 operatively coupled to the drive turbine 116. In some examples, the turbo pump 124 is hermetically-sealed within a casing. The heat engine systems 100*a* and 100*b* also contain the start pump 129 arranged in series with the turbo pump 124 along the working fluid circuit 102. The heat engine systems 100*a* and 100*b* generally have a first check valve 146 arranged in the working fluid circuit 102 downstream of the pump portion 104 of the turbo pump 124. The heat engine system 100*a* also has a second check valve 148 arranged in the working fluid circuit 102 downstream of the pump portion 128 of the start pump 129 and fluidly coupled to the first check valve 146.

The heat engine systems 100*a* and 100*b* further contain the power turbine 110 fluidly coupled to both the pump portion 104 of the turbo pump 124 and the pump portion 128 of the start pump 129, a first recirculation line 152 fluidly coupling the pump portion 104 with a low pressure side of the working fluid circuit 102. In some configurations, the heat engine system 100*a* or 100*b* may contain a recuperator or condenser 122 fluidly coupled downstream of the power turbine 110 and an additional recuperator or condenser (not shown) fluidly coupled to the drive turbine 116. In other configurations, the heat engine system 100*a* or 100*b* may contain a third recuperator or condenser fluidly coupled to the additional recuperator or condenser, wherein the first, second, and third recuperator or condensers are disposed in series along the working fluid circuit 102.

In other embodiments disclosed herein, a method for starting the turbo pump 124 in the heat engine system 100*a*, 100*b* and/or generating electricity with the heat engine system 100*a*, 100*b* is provided and includes circulating a working fluid within the working fluid circuit 102 by a start pump and transferring thermal energy from the heat source stream 90 to the working fluid by the first heat exchanger 103 fluidly coupled to and in thermal communication with the working fluid circuit 102. Generally, the working fluid has a first mass flow and a second mass flow within the working fluid circuit 102 and at least a portion of the working fluid circuit contains the working fluid in a supercritical state. The method further includes flowing the working fluid into the drive turbine 116 of the turbo pump 124 and expanding the working fluid while converting the thermal energy from the working fluid to mechanical energy of the drive turbine 116 and driving the pump portion 104 of the turbo pump 124 by the mechanical energy of the drive turbine 116. The pump portion 104 may be coupled to the drive turbine 116 and the working fluid may be circulated within the working fluid circuit 102 by the turbo pump 124. The method also includes diverting the working fluid discharged from the pump portion 104 of the turbo pump 124 into a first recirculation line 152 fluidly communicating the pump portion 104 of the turbo pump 124 with a low pressure side of the working fluid circuit 102 and closing a first bypass valve 154 arranged in the first recirculation line 152 as the turbo pump 124 reaches a self-sustaining speed of operation.

In other embodiments, the heat engine system 100*a* may be utilized while performing several methods disclosed herein. The method may further include deactivating the start pump 129 in the heat engine system 100*a* and opening the second bypass valve 160 arranged in the second recirculation line 158 fluidly communicating the start pump 129 with the low pressure side of the working fluid circuit 102 and diverting the working fluid discharged from the start pump 129 into the second recirculation line 158. Also, the method further includes flowing the working fluid into the power turbine 110 and converting the thermal energy from the working fluid to mechanical energy of the power turbine 110 and converting the mechanical energy of the power turbine 110 into electrical energy by the power generator 112 coupled to the power turbine 110.

In some embodiments, the method includes circulating the working fluid in the working fluid circuit 102 with the start pump 129 is preceded by closing a shut-off valve to divert the working fluid around the power turbine 110 arranged in the working fluid circuit 102. In other embodiments, the method further includes opening the shut-off valve once the turbo pump 124 reaches the self-sustaining speed of operation, thereby directing the working fluid into the power turbine 110, expanding the working fluid in the power turbine 110, and driving the power generator 112 operatively coupled to the power turbine 110 to generate electrical power. In other embodiments, the method further includes opening the shut-off valve or the control valve 133 once the turbo pump 124 reaches the self-sustaining speed of operation, directing the working fluid into the second heat exchanger 103 fluidly coupled to the power turbine 110 and in thermal communication with the heat source stream 90, transferring additional thermal energy from the heat source stream 90 to the working fluid in the second heat exchanger 103, expanding the working fluid received from the second heat exchanger 103 in the power turbine 110, and driving the power generator 112 operatively coupled to the power turbine 110, whereby the power generator 112 is operable to generate electrical power.

In some embodiments, the method also includes opening the shut-off valve once the turbo pump 124 reaches the self-sustaining speed of operation, directing the working fluid into a second heat exchanger in thermal communication with the heat source stream 90, the first and second heat exchangers, within the heat exchangers 103, being arranged in series in the heat source stream 90, directing the working fluid from the second heat exchanger into a third heat exchanger fluidly coupled to the power turbine 110 and in thermal communication with the heat source stream 90, the first, second, and third heat exchangers, within the heat exchangers 103, being arranged in series in the heat source stream 90, transferring additional thermal energy from the heat source stream 90 to the working fluid in the third heat exchanger, expanding the working fluid received from the third heat exchanger in the power turbine 110, and driving the power generator 112 operatively coupled to the power turbine 110, whereby the power generator 112 is operable to generate electrical power.

Figure 2:
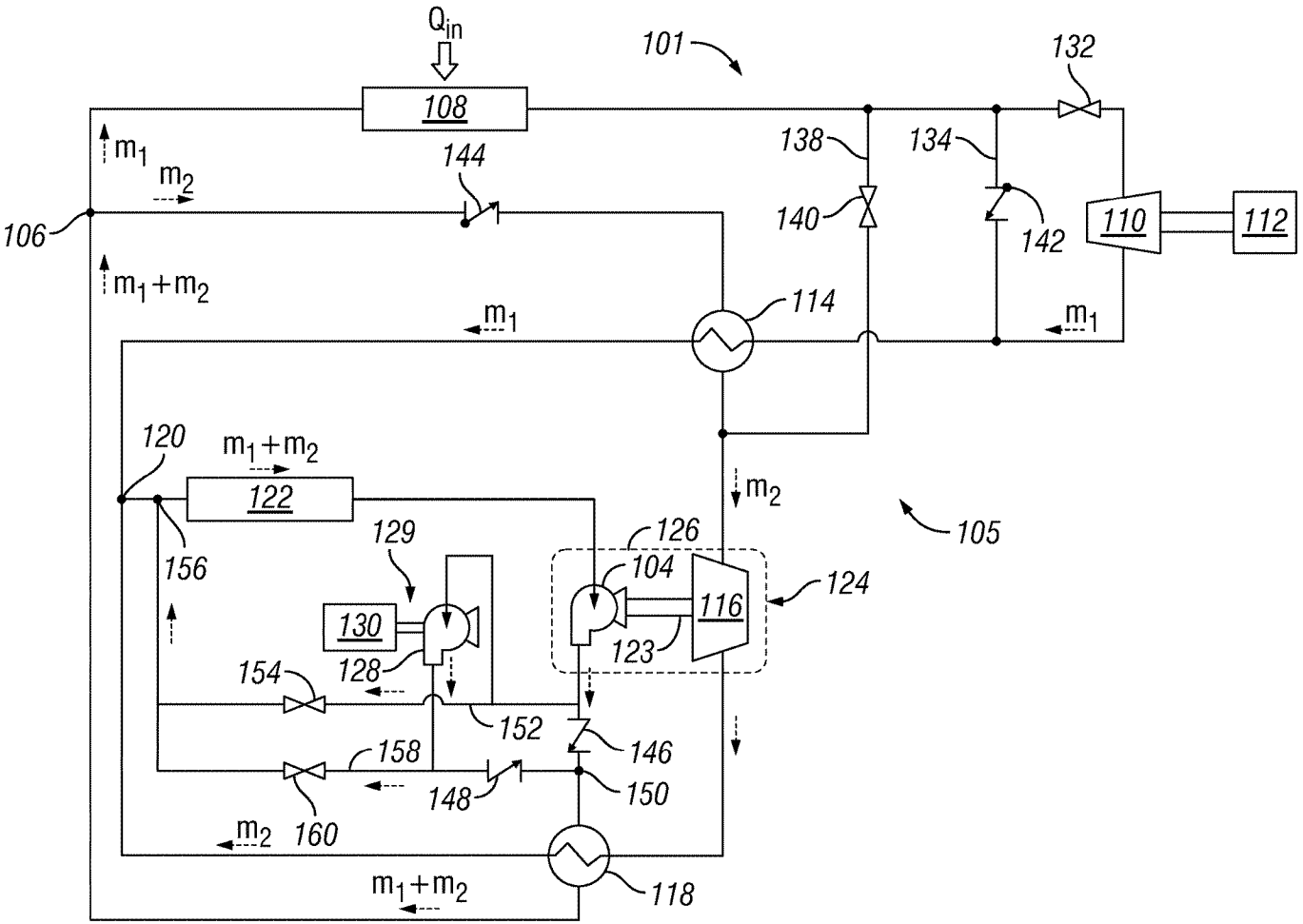
FIG. 2 illustrates a schematic of a heat engine system configured with a cascade thermodynamic waste heat recovery cycle, according to one or more embodiments disclosed herein.

FIG. 2 depicts an exemplary heat engine system 101 configured as a closed-loop thermodynamic cycle and operated to circulate a working fluid throughout a working fluid circuit 105. Heat engine system 101 illustrates further detail and may be similar in several respects to the heat engine system 100*a* described above. Accordingly, the heat engine system 101 may be further understood with reference to FIGS. 1A-1B, where like numerals indicate like components that will not be described again in detail. The heat engine system 101 may be characterized as a "cascade" thermodynamic cycle, where residual thermal energy from expanded working fluid is used to preheat additional working fluid before its respective expansion. Other exemplary cascade thermodynamic cycles that may also be implemented into the present disclosure may be found in PCT Appl. No. PCT/US11/29486, entitled "Heat Engines with Cascade Cycles," filed on Mar. 22, 2011, and published as WO 2011/119650, the contents of which are hereby incorporated by reference. The working fluid circuit 105 generally contains a variety of conduits adapted to interconnect the various components of the heat engine system 101. Although the heat engine system 101 may be characterized as a closed-loop cycle, the heat engine system 101 as a whole may or may not be hermetically-sealed such that no amount of working fluid is leaked into the surrounding environment. The heat engine system 101 generally has an automated control system (not shown) configured to regulate, operate, or otherwise control the valves and other components therein.

Heat engine system 101 includes a heat exchanger 108 that is in thermal communication with a heat source stream $Q_{in}$. The heat source stream $Q_{in}$ may derive thermal energy from a variety of high temperature sources. For example, the heat source stream $Q_{in}$ may be a waste heat stream such as, but not limited to, gas turbine exhaust, process stream exhaust, other combustion product exhaust streams, such as furnace or boiler exhaust streams, or other heated stream flowing from a one or more heat sources. Accordingly, the thermodynamic cycle or heat engine system 101 may be configured to transform waste heat into electricity for applications ranging from bottom cycling in gas turbines, stationary diesel engine gensets, industrial waste heat recovery (e.g., in refineries and compression stations), and hybrid alternatives to the internal combustion engine. In other embodiments, the heat source stream $Q_{in}$ may derive thermal energy from renewable sources of thermal energy such as, but not limited to, solar thermal and geothermal sources.

While the heat source stream $Q_{in}$ may be a fluid stream of the high temperature source itself, in other embodiments the heat source stream $Q_{in}$ may be a thermal fluid in contact with the high temperature source. The thermal fluid may deliver the thermal energy to the waste heat exchanger 108 to transfer the energy to the working fluid in the circuit 105.

After being discharged from the pump portion 104, the combined working fluid $m_1+m_2$ is split into the first and second mass flows $m_1$ and $m_2$, respectively, at point 106 in the working fluid circuit 105. The first mass flow $m_1$ is directed to a heat exchanger 108 in thermal communication with a heat source stream $Q_{in}$. The respective mass flows $m_1$ and $m_2$ may be controlled by the user, control system, or by the configuration of the system, as desired.

A power turbine 110 is arranged downstream of the heat exchanger 108 for receiving and expanding the first mass flow $m_1$ discharged from the heat exchanger 108. The power turbine 110 is operatively coupled to an alternator, power generator 112, or other device or system configured to receive shaft work. The power generator 112 converts the mechanical work generated by the power turbine 110 into usable electrical power.

The power turbine 110 discharges the first mass flow $m_1$ into a first recuperator 114 fluidly coupled downstream thereof. The first recuperator 114 may be configured to transfer residual thermal energy in the first mass flow $m_1$ to the second mass flow $m_2$ which also passes through the first recuperator 114. Consequently, the temperature of the first mass flow $m_1$ is decreased and the temperature of the second mass flow $m_2$ is increased. The second mass flow $m_2$ may be subsequently expanded in a drive turbine 116.

The drive turbine 116 discharges the second mass flow $m_2$ into a second recuperator 118 fluidly coupled downstream thereof. The second recuperator 118 may be configured to transfer residual thermal energy from the second mass flow $m_2$ to the combined working fluid $m_1+m_2$ originally discharged from the pump portion 104. The mass flows $m_1$, $m_2$ discharged from each recuperator 114, 118, respectively, are recombined at point 120 in the working fluid circuit 102 and then returned to a lower temperature state at a condenser 122. After passing through the condenser 122, the combined working fluid $m_1+m_2$ is returned to the pump portion 104 and the cycle is started anew.

The recuperators 114, 118 and the condenser 122 may be any device adapted to reduce the temperature of the working fluid such as, but not limited to, a direct contact heat exchanger, a trim cooler, a mechanical refrigeration unit, and/or any combination thereof. The heat exchanger 108, recuperators 114, 118, and/or the condenser 122 may include or employ one or more printed circuit heat exchange panels. Such heat exchangers and/or panels are known in the art, and are described in U.S. Pat. Nos. 6,921,518; 7,022,294; and 7,033,553, the contents of which are incorporated by reference to the extent consistent with the present disclosure.

In one or more embodiments, the heat source stream $Q_{in}$ may be at a temperature of approximately 200° C., or a temperature at which the turbo pump 124 is able to achieve self-sustaining operation. As can be appreciated, higher heat source stream temperatures can be utilized, without departing from the scope of the disclosure. To keep thermally-induced stresses in a manageable range, however, the working fluid temperature can be "tempered" through the use of liquid carbon dioxide injection upstream of the drive turbine 116.

To facilitate the start sequence of the turbo pump 124, the heat engine system 101 may further include a series of check valves, bypass valves, and/or shut-off valves arranged at predetermined locations throughout the circuit 105. These valves may work in concert to direct the working fluid into the appropriate conduits until the steady-state operation of turbo pump 124 is maintained. In one or more embodiments, the various valves may be automated or semi-automated motor-driven valves coupled to an automated control system (not shown). In other embodiments, the valves may be manually-adjustable or may be a combination of automated and manually-adjustable.

For example, a shut-off valve 132 arranged upstream from the power turbine 110 may be closed during the start-up and/or ramp-up of the heat engine system 101. Consequently, after being heated in the heat exchanger 108, the first mass flow $m_1$ is diverted around the power turbine 110 via a first diverter line 134 and a second diverter line 138. A bypass valve 140 is arranged in the second diverter line 138 and a check valve 142 is arranged in the first diverter line 134. The portion of working fluid circulated through the first diverter line 134 may be used to preheat the second mass flow $m_2$ in the first recuperator 114. A check valve 144 allows the second mass flow $m_2$ to flow through to the first recuperator 114. The portion of the working fluid circulated through the second diverter line 138 is combined with the second mass flow $m_2$ discharged from the first recuperator 114 and injected into the drive turbine 116 in a high-temperature condition.

Once the turbo pump 124 reaches steady-state operating speeds, and even once a self-sustaining speed is achieved, the shut-off valve 132 arranged upstream from the power turbine 110 may be opened and the bypass valve 140 may be simultaneously closed. As a result, the heated stream of first mass flow $m_1$ may be directed through the power turbine 110 to commence generation of electrical power.

Figure 3:
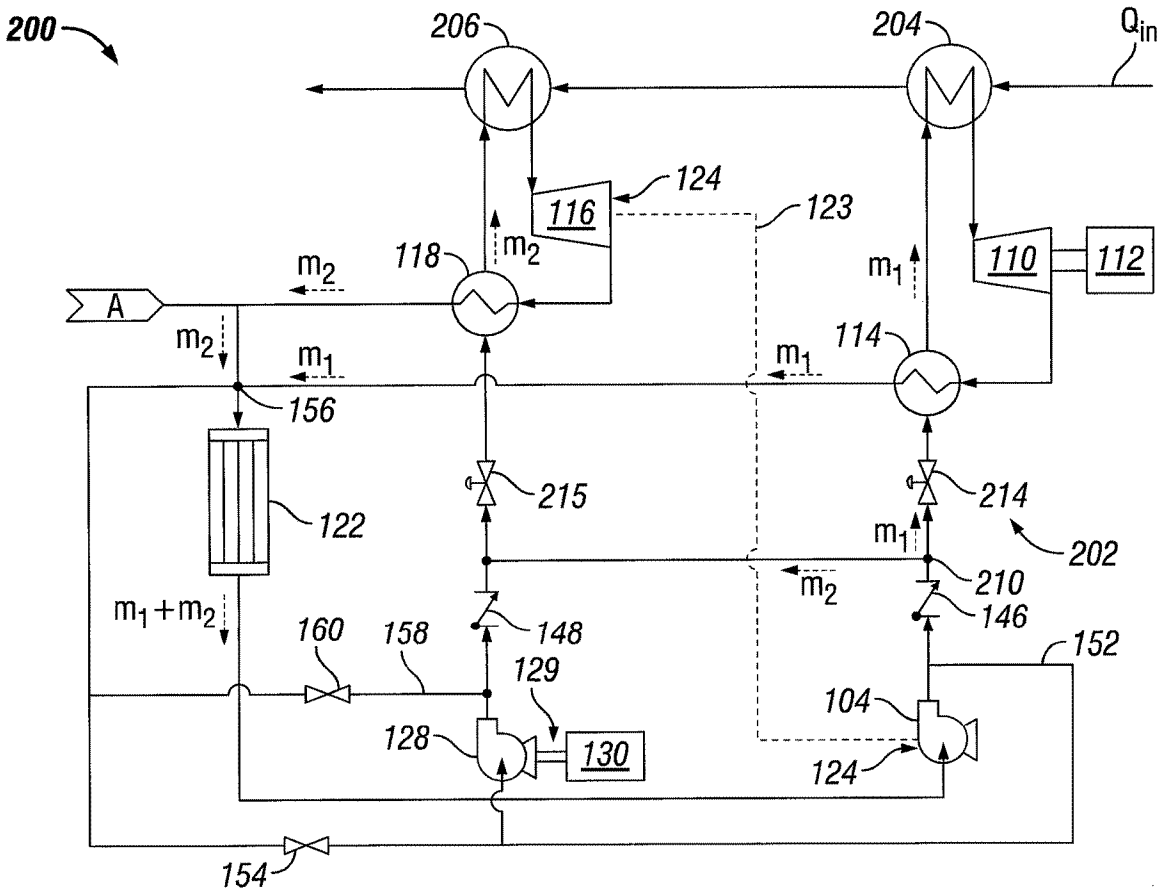
FIG. 3 illustrates a schematic of a heat engine system configured with a parallel heat engine cycle, according to one or more embodiments disclosed herein.

FIG. 3 depicts an exemplary heat engine system 200 configured with a parallel-type heat engine cycle, according to one or more embodiments disclosed herein. The heat engine system 200 may be similar in several respects to the heat engine systems 100*a*, 100*b*, and 101 described above. Accordingly, the heat engine system 200 may be further understood with reference to FIGS. 1A, 1B, and 2, where like numerals indicate like components that will not be described again in detail. As with the heat engine system 100*a* described above, the heat engine system 200 in FIG. 3 may be used to convert thermal energy to work by thermal expansion of a working fluid mass flowing through a working fluid circuit 202. The heat engine system 200, however, may be characterized as a parallel-type Rankine thermodynamic cycle.

Specifically, the working fluid circuit 202 may include a first heat exchanger 204 and a second heat exchanger 206 arranged in thermal communication with the heat source stream $Q_{in}$. The first and second heat exchangers 204, 206 may correspond generally to the heat exchanger 108 described above with reference to FIG. 2. For example, in one embodiment, the first and second heat exchangers 204, 206 may be first and second stages, respectively, of a single or combined heat exchanger. The first heat exchanger 204 may serve as a high temperature heat exchanger (e.g., a higher temperature relative to the second heat exchanger 206) adapted to receive initial thermal energy from the heat source stream $Q_{in}$. The second heat exchanger 206 may then receive additional thermal energy from the heat source stream $Q_{in}$ via a serial connection downstream of the first heat exchanger 204. The heat exchangers 204, 206 are arranged in series with the heat source stream $Q_{in}$, but in parallel in the working fluid circuit 202.

The first heat exchanger 204 may be fluidly coupled to the power turbine 110 and the second heat exchanger 206 may be fluidly coupled to the drive turbine 116. In turn, the power turbine 110 is fluidly coupled to the first recuperator 114 and the drive turbine 116 is fluidly coupled to the second recuperator 118. The recuperators 114, 118 may be arranged in series on a low temperature side of the circuit 202 and in parallel on a high temperature side of the circuit 202. For example, the high temperature side of the circuit 202 includes the portions of the circuit 202 arranged downstream of each recuperator 114, 118 where the working fluid is directed to the heat exchangers 204, 206. The low temperature side of the circuit 202 includes the portions of the circuit 202 downstream of each recuperator 114, 118 where the working fluid is directed away from the heat exchangers 204, 206.

The turbo pump 124 is also included in the working fluid circuit 202, where the pump portion 104 is operatively coupled to the drive turbine 116 via the drive shaft 123 (indicated by the dashed line), as described above. The pump portion 104 is shown separated from the drive turbine 116 only for ease of viewing and describing the circuit 202. Indeed, although not specifically illustrated, it will be appreciated that both the pump portion 104 and the drive turbine 116 may be hermetically-sealed within the casing 126 (FIG. 1). The start pump 129 facilitates the start sequence for the turbo pump 124 during start-up of the heat engine system 200 and ramp-up of the turbo pump 124. Once steady-state operation of the turbo pump 124 is reached, the start pump 129 may be deactivated.

The power turbine 110 may operate at a higher relative temperature (e.g., higher turbine inlet temperature) than the drive turbine 116, due to the temperature drop of the heat source stream $Q_{in}$ experienced across the first heat exchanger 204. The power turbine 110 and the drive turbine 116 may each be configured to operate at the same or substantially the same inlet pressure. The low-pressure discharge mass flow exiting each recuperator 114, 118 may be directed through the condenser 122 to be cooled for return to the low temperature side of the circuit 202 and to either the main or start pump portions 104, 128, depending on the stage of operation.

During steady-state operation of the heat engine system 200, the turbo pump 124 circulates all of the working fluid throughout the circuit 202 using the pump portion 104, and the start pump 129 does not generally operate nor is needed. The first bypass valve 154 in the first recirculation line 152 is fully closed and the working fluid is separated into the first and second mass flows $m_1$, $m_2$ at point 210. The first mass flow $m_1$ is directed through the first heat exchanger 204 and subsequently expanded in the power turbine 110 to generate electrical power via the power generator 112. Following the power turbine 110, the first mass flow $m_1$ passes through the first recuperator 114 and transfers residual thermal energy to the first mass flow $m_1$ as the first mass flow $m_1$ is directed toward the first heat exchanger 204.

The second mass flow $m_2$ is directed through the second heat exchanger 206 and subsequently expanded in the drive turbine 116 to drive the pump portion 104 via the drive shaft 123. Following the drive turbine 116, the second mass flow $m_2$ passes through the second recuperator 118 to transfer residual thermal energy to the second mass flow $m_2$ as the second mass flow $m_2$ courses toward the second heat exchanger 206. The second mass flow $m_2$ is then re-combined with the first mass flow $m_1$ and the combined mass flow $m_1+m_2$ is subsequently cooled in the condenser 122 and directed back to the pump portion 104 to commence the fluid loop anew.

During the start-up of the heat engine system 200 or ramp-up of the turbo pump 124, the start pump 129 may be engaged and operated to start spinning the turbo pump 124. To help facilitate this start-up or ramp-up, a shut-off valve 214 arranged downstream of point 210 is initially closed such that no working fluid is directed to the first heat exchanger 204 or otherwise expanded in the power turbine 110. Rather, all the working fluid discharged from the pump portion 128 is directed through a valve 215 to the second heat exchanger 206 and the drive turbine 116. The heated working fluid expands in the drive turbine 116 and drives the pump portion 104, thereby commencing operation of the turbo pump 124.

The head pressure generated by the pump portion 128 of the turbo pump 124 near point 210 prevents the low pressure working fluid discharged from the pump portion 104 during ramp-up from traversing the first check valve 146. Until the pump portion 104 is able to accelerate past the stall speed of the turbo pump 124, the first bypass valve 154 in the first recirculation line 152 may be fully opened to recirculate the low pressure working fluid back to a low pressure point in the working fluid circuit 202, such as at point 156 adjacent the inlet of the condenser 122. The inlet of pump portion 128 is in fluid communication with the first recirculation line 152 at a point upstream of the first bypass valve 154. Once the turbo pump 124 reaches a self-sustaining speed, the bypass valve 154 may be gradually closed to increase the discharge pressure of the pump portion 104 and also decrease the flow rate through the first recirculation line 152. Once the turbo pump 124 reaches steady-state operation, and even once a self-sustaining speed is achieved, the shut-off valve 214 may be gradually opened, thereby allowing the first mass flow $m_1$ to be expanded in the power turbine 110 to commence generating electrical energy. The heat engine system 200 generally has an automated control system (not shown) configured to regulate, operate, or otherwise control the valves and other components therein.

The start pump 129 can gradually be powered down and deactivated with the turbo pump 124 operating at steady-state operating speeds. Deactivating the start pump 129 may include simultaneously opening the second bypass valve 160 arranged in the second recirculation line 158. The second bypass valve 160 allows the increasingly lower pressure working fluid discharged from the pump portion 128 to escape to the low pressure side of the working fluid circuit (e.g., point 156). Eventually the second bypass valve 160 may be completely opened as the speed of the pump portion 128 slows to a stop and the second check valve 148 prevents working fluid discharged by the pump portion 104 from advancing toward the discharge of the pump portion 128. At steady-state, the turbo pump 124 continuously pressurizes the working fluid circuit 202 in order to drive both the drive turbine 116 and the power turbine 110.

Figure 4:
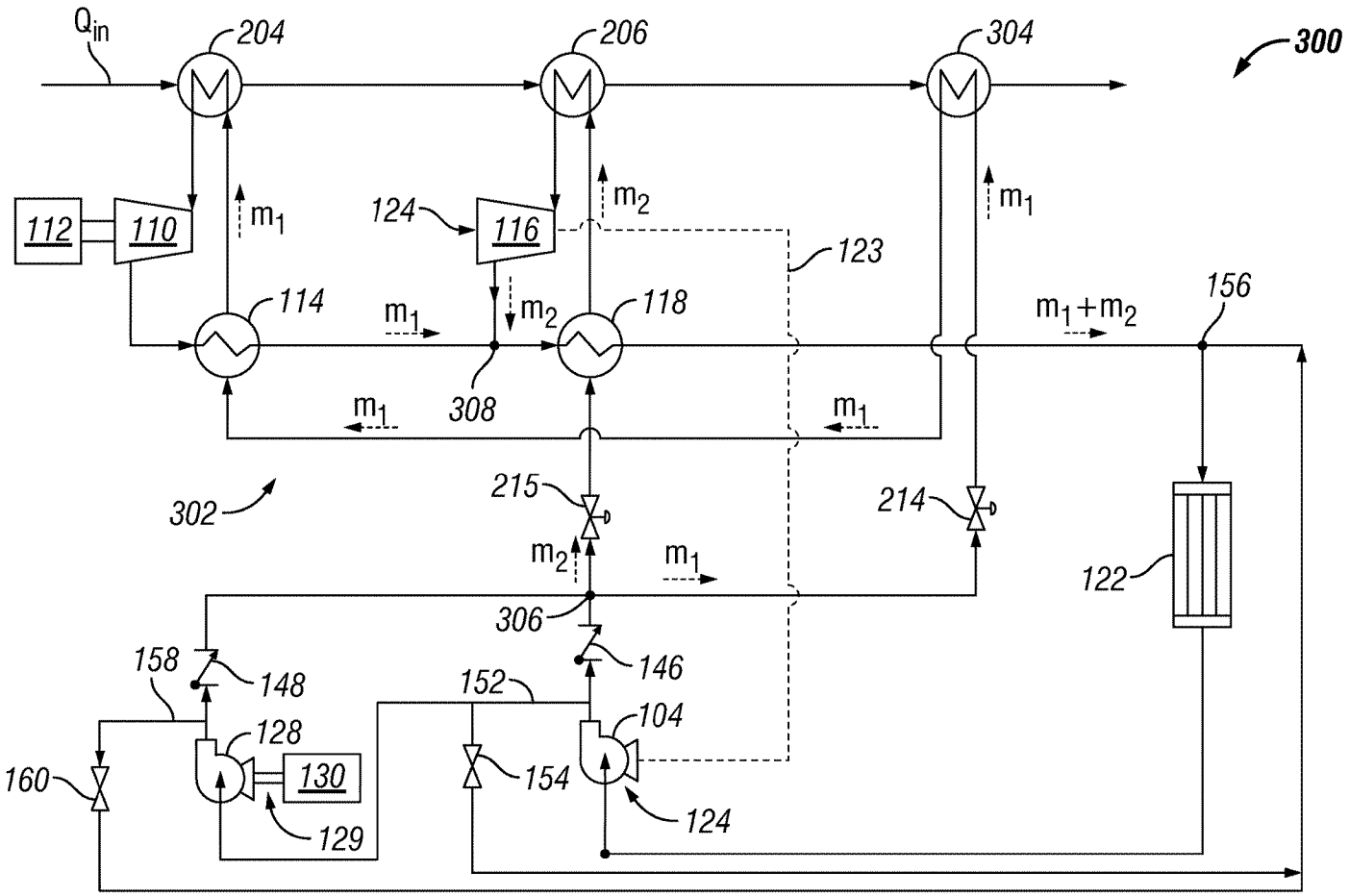
FIG. 4 illustrates a schematic of another heat engine system configured with another parallel heat engine cycle, according to one or more embodiments disclosed herein.

FIG. 4 depicts a schematic of a heat engine system 300 configured with a parallel-type heat engine cycle, according to one or more embodiments disclosed herein. The heat engine system 300 may be similar in some respects to the above-described the heat engine systems 100*a*, 100*b*, 101, and 200, and therefore, may be best understood with reference to FIGS. 1A, 1B, 2, and 3, respectively, where like numerals correspond to like elements that will not be described again. The heat engine system 300 includes a working fluid circuit 302 utilizing a third heat exchanger 304 also in thermal communication with the heat source stream $Q_{in}$. The heat exchangers 204, 206, and 304 are arranged in series with the heat source stream $Q_{in}$, but arranged in parallel in the working fluid circuit 302.

The turbo pump 124 (e.g., the combination of the pump portion 104 and the drive turbine 116 operatively coupled via the drive shaft 123) is arranged and configured to operate in series with the start pump 129, especially during the start-up of the heat engine system 300 and the ramp-up of the turbo pump 124. During steady-state operation of the heat engine system 300, the start pump 129 does not generally operate. Instead, the pump portion 104 solely discharges the working fluid that is subsequently separated into first and second mass flows $m_1$, $m_2$, respectively, at point 306. The third heat exchanger 304 may be configured to transfer thermal energy from the heat source stream $Q_{in}$ to the first mass flow $m_1$ flowing therethrough. The first mass flow $m_1$ is then directed to the first heat exchanger 204 and the power turbine 110 for expansion power generation. Following expansion in the power turbine 110, the first mass flow $m_1$ passes through the first recuperator 114 to transfer residual thermal energy to the first mass flow $m_1$ discharged from the third heat exchanger 304 and coursing toward the first heat exchanger 204.

The second mass flow $m_2$ is directed through the valve 215, the second recuperator 118, the second heat exchanger 206, and subsequently expanded in the drive turbine 116 to drive the pump portion 104. After being discharged from the drive turbine 116, the second mass flow $m_2$ merges with the first mass flow $m_1$ at point 308. The combined mass flow $m_1+m_2$ thereafter passes through the second recuperator 118 to provide residual thermal energy to the second mass flow $m_2$ as the second mass flow $m_2$ courses toward the second heat exchanger 206.

During the start-up of the heat engine system 300 and/or the ramp-up of the turbo pump 124, the pump portion 128 draws working fluid from the first bypass line 152 and circulates the working fluid to commence spinning of the turbo pump 124. The shut-off valve 214 may be initially closed to prevent working fluid from circulating through the first and third heat exchangers 204, 304 and being expanded in the power turbine 110. The working fluid discharged from the pump portion 128 is directed through the second heat exchanger 206 and drive turbine 116. The heated working fluid expands in the drive turbine 116 and drives the pump portion 104, thereby commencing operation of the turbo pump 124.

Until the discharge pressure of the pump portion 104 of the turbo pump 124 accelerates past the stall speed of the turbo pump 124 and can withstand the head pressure generated by the pump portion 128 of the start pump 129, any working fluid discharged from the pump portion 104 is either directed toward the pump portion 128 or recirculated via the first recirculation line 152 back to a low pressure point in the working fluid circuit 202 (e.g., point 156). Once the turbo pump 124 becomes self-sustaining, the bypass valve 154 may be gradually closed to increase the pump portion 104 discharge pressure and decrease the flow rate in the first recirculation line 152. Then, the shut-off valve 214 may also be gradually opened to begin circulation of the first mass flow $m_1$ through the power turbine 110 to generate electrical energy. Subsequently, the start pump 129 in the heat engine system 300 may be gradually deactivated while simultaneously opening the second bypass valve 160 arranged in the second recirculation line 158. Eventually the second bypass valve 160 is completely opened and the pump portion 128 can be slowed to a stop. The heat engine system 300 generally has an automated control system (not shown) configured to regulate, operate, or otherwise control the valves and other components therein.

Figure 5:
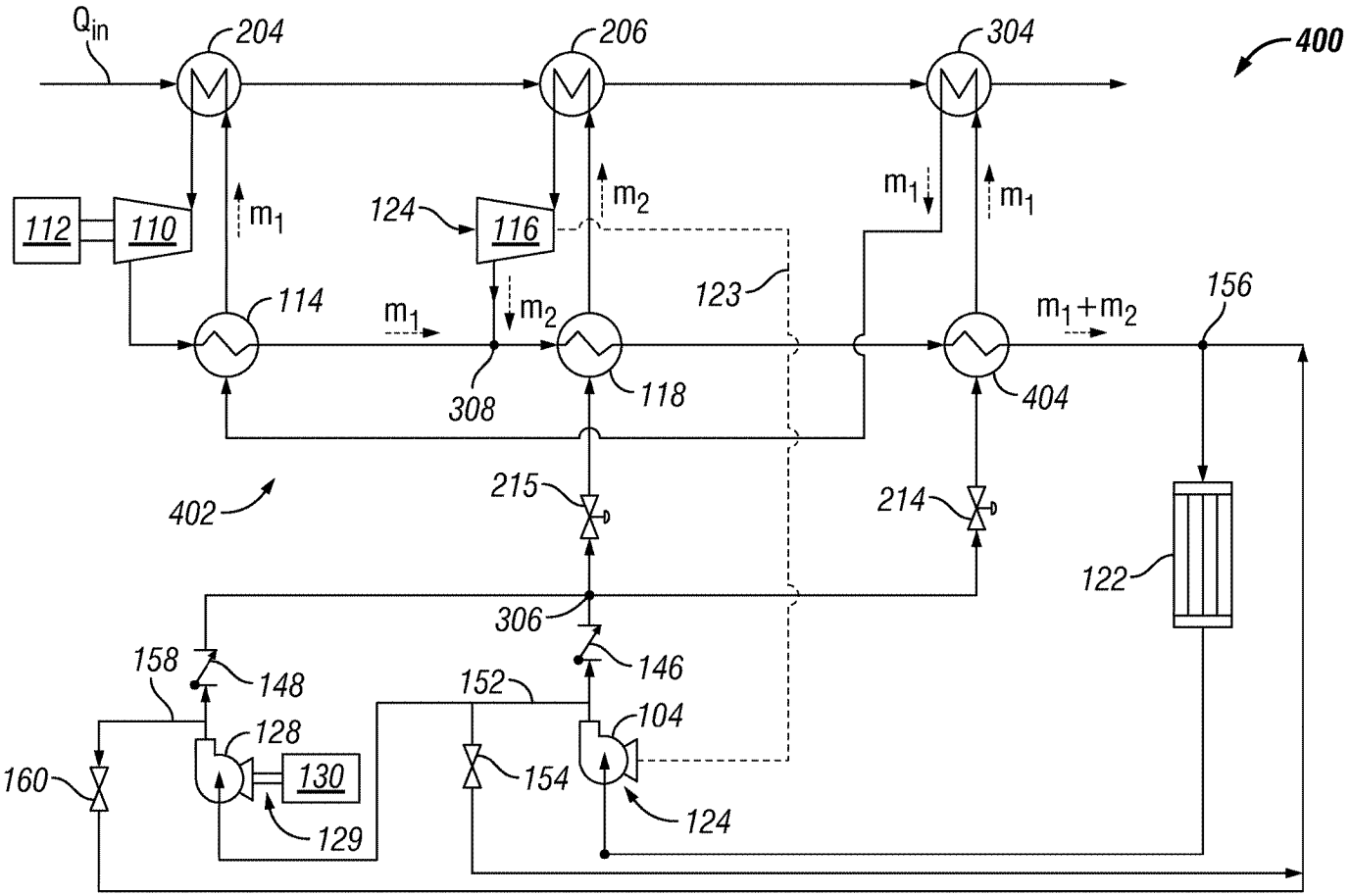
FIG. 5 illustrates a schematic of another heat engine system configured with another parallel heat engine cycle, according to one or more embodiments disclosed herein.

FIG. 5 depicts a schematic of a heat engine system 400 configured with another parallel-type heat engine cycle, according to one or more embodiments disclosed herein. The heat engine system 400 may be similar to the heat engine system 300, and as such, may be best understood with reference to FIG. 3 where like numerals correspond to like elements that will not be described again. The working fluid circuit 402 depicted in FIG. 5 is substantially similar to the working fluid circuit 302 depicted in FIG. 4 but with the exception of an additional, third recuperator 404. The third recuperator 404 may be adapted to extract additional thermal energy from the combined mass flow $m_1+m_2$ discharged from the second recuperator 118. Accordingly, the working fluid in the first mass flow $m_1$ entering the third heat exchanger 304 may be preheated in the third recuperator 404 prior to receiving thermal energy transferred from the heat source stream $Q_{in}$.

As illustrated, the recuperators 114, 118, and 404 may operate as separate heat exchanging devices. In other embodiments, however, the recuperators 114, 118, and 404 may be combined as a single, integral recuperator. Steady-state operation, system start-up, and turbo pump 124 ramp-up may operate substantially similar as described above in FIG. 3, and therefore will not be described again.

Each of the described systems in FIGS. 1A-5 may be implemented in a variety of physical embodiments, including but not limited to fixed or integrated installations, or as a self-contained device such as a portable waste heat engine "skid". The waste heat engine skid may be configured to arrange each working fluid circuit and related components (e.g., turbines 110, 116, recuperators 114, 118, 404, condensers 122, pump portions 104, 128, and/or other components) in a consolidated, single unit. An exemplary waste heat engine skid is described and illustrated in commonly assigned U.S. application Ser. No. 12/631,412, entitled "Thermal Energy Conversion Device," filed on Dec. 9, 2009, and published as US 2011-0185729, wherein the contents are hereby incorporated by reference to the extent consistent with the present disclosure.

Figure 6:
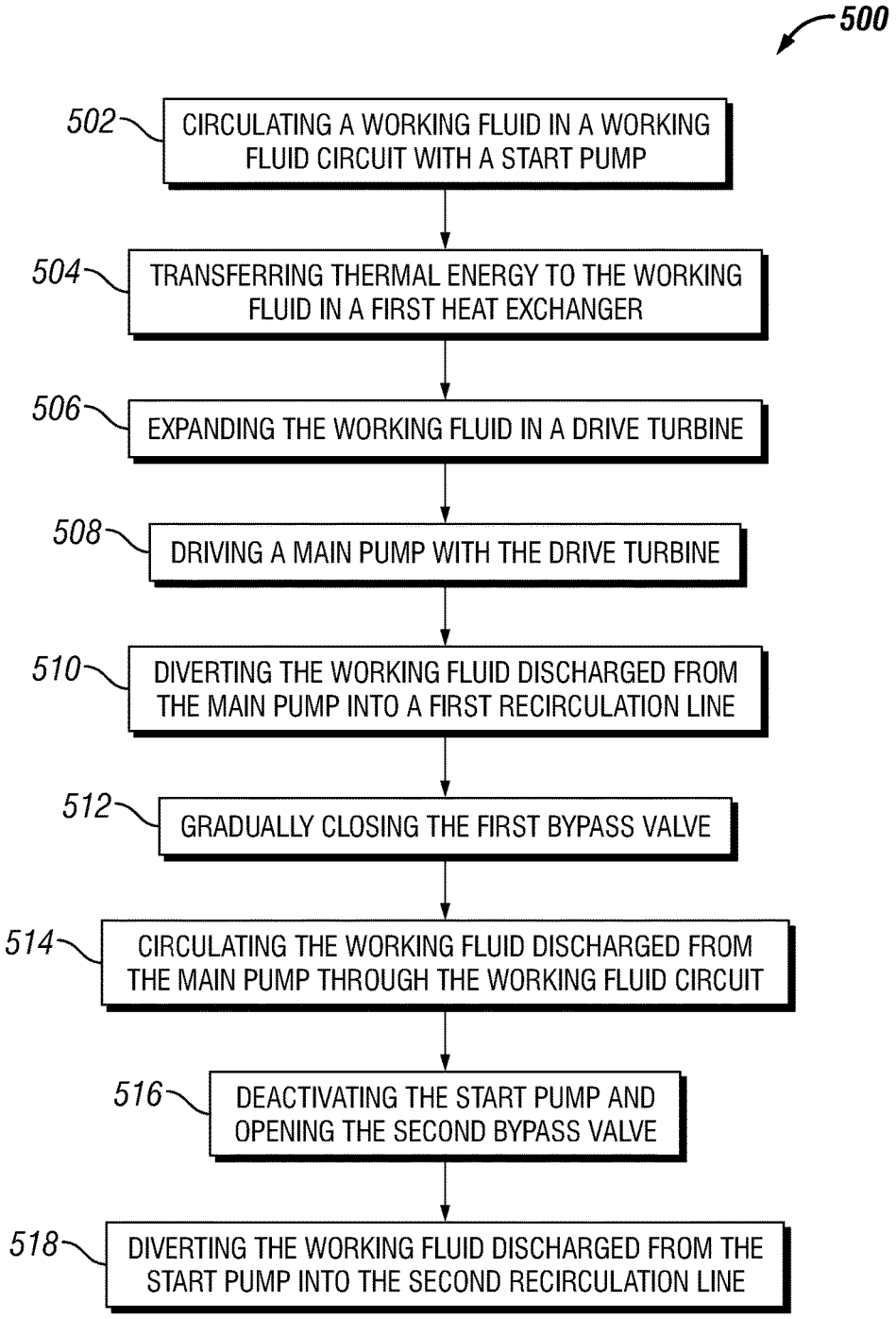
FIG. 6 is a flowchart of a method for starting a turbo pump in a heat engine system having a thermodynamic working fluid circuit, according to one or more embodiments disclosed herein.

FIG. 6 is a flowchart of a method 500 for starting a turbo pump in a heat engine system having a thermodynamic working fluid circuit utilized during operation, according to one or more embodiments disclosed herein. The method 500 includes circulating a working fluid in the working fluid circuit with a start pump that is connected in series with the turbo pump, as at 502. The start pump may be in fluid communication with a first heat exchanger, and the first heat exchanger may be in thermal communication with a heat source stream. Thermal energy is transferred to the working fluid from the heat source stream in the first heat exchanger, as at 504. The method 500 further includes expanding the working fluid in a drive turbine, as at 506. The drive turbine is fluidly coupled to the first heat exchanger, and the drive turbine is operatively coupled to a pump portion, such that the combination of the drive turbine and pump portion is the turbo pump.

The pump portion is driven with the drive turbine, as at 508. Until the pump portion accelerates past the stall point of the pump, the working fluid discharged from the pump portion is diverted to the start pump or into a first recirculation line, as at 510. The first recirculation line may fluidly communicate the pump portion with a low pressure side of the working fluid circuit. Moreover, a first bypass valve may be arranged in the first recirculation line. As the turbo pump reaches a self-sustaining speed of operation, the first bypass valve may gradually begin to close, as at 512. Consequently, the pump portion begins circulating the working fluid discharged from the pump portion through the working fluid circuit, as at 514.

The method 500 may also include deactivating the start pump and opening a second bypass valve arranged in a second recirculation line, as at 516. The second recirculation line may fluidly communicate the start pump with the low pressure side of the working fluid circuit. The low pressure working fluid discharged from the start pump may be diverted into the second recirculation line until the start pump comes to a stop, as at 518.

It is to be understood that the present disclosure describes several exemplary embodiments for implementing different features, structures, or functions of the disclosure. Exemplary embodiments of components, arrangements, and configurations are described herein to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, e.g., any element from one exemplary embodiment may be used in any other exemplary embodiment without departing from the scope of the disclosure.

Additionally, certain terms are used throughout the written description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method for starting a turbo pump in a heat engine system, comprising:

circulating a working fluid comprising carbon dioxide within a working fluid circuit by a start pump, wherein the working fluid circuit contains a first mass flow of the working fluid and a second mass flow of the working fluid and at least a portion of the working fluid circuit contains the working fluid in a supercritical state;

transferring thermal energy from a heat source stream to the working fluid by a first heat exchanger fluidly coupled to and in thermal communication with the working fluid circuit;

flowing the working fluid into a drive turbine of a turbo pump and expanding the working fluid while converting the thermal energy from the working fluid to mechanical energy of the drive turbine;

driving a pump portion of the turbo pump by the mechanical energy of the drive turbine, wherein the pump portion is coupled to the drive turbine and the working fluid is circulated within the working fluid circuit by the turbo pump;

diverting the working fluid discharged from the pump portion of the turbo pump into a first recirculation line fluidly communicating the pump portion of the turbo pump with a low pressure side of the working fluid circuit, the first recirculation line having a first bypass valve arranged therein;

closing the first bypass valve as the turbo pump reaches a self-sustaining speed of operation;

deactivating the start pump and opening a second bypass valve arranged in a second recirculation line fluidly communicating the start pump with the working fluid circuit; and diverting the working fluid discharged from the start pump into the second recirculation line.

2. The method of claim 1, further comprising:

flowing the working fluid into a power turbine and converting the thermal energy from the working fluid to mechanical energy of the power turbine; and converting the mechanical energy of the power turbine into electrical energy by a power generator coupled to the power turbine.

3. The method of claim 1, wherein circulating the working fluid in the working fluid circuit with the start pump is preceded by closing a shut-off valve to divert the working fluid around a power turbine arranged in the working fluid circuit.

4. The method of claim 3, further comprising:

opening the shut-off valve once the turbo pump reaches the self-sustaining speed of operation, thereby directing the working fluid into the power turbine;

expanding the working fluid in the power turbine; and driving a generator operatively coupled to the power turbine to generate electrical power.

5. The method of claim 3, further comprising:

opening the shut-off valve once the turbo pump reaches the self-sustaining speed of operation;

directing the working fluid into a second heat exchanger fluidly coupled to the power turbine and in thermal communication with the heat source stream;

transferring additional thermal energy from the heat source stream to the working fluid in the second heat exchanger;

expanding the working fluid received from the second heat exchanger in the power turbine; and driving a generator operatively coupled to the power turbine, whereby the generator is operable to generate electrical power.

6. The method of claim 3, further comprising:

opening the shut-off valve once the turbo pump reaches the self-sustaining speed of operation;

directing the working fluid into a second heat exchanger in thermal communication with the heat source stream, the first and second heat exchangers being arranged in series in the heat source stream;

directing the working fluid from the second heat exchanger into a third heat exchanger fluidly coupled to the power turbine and in thermal communication with the heat source stream, the first, second, and third heat exchangers being arranged in series in the heat source stream;

transferring additional thermal energy from the heat source stream to the working fluid in the third heat exchanger;

expanding the working fluid received from the third heat exchanger in the power turbine; and driving a generator operatively coupled to the power turbine, whereby the generator is operable to generate electrical power.

7. The method of claim 1, wherein:

the working fluid discharged from the pump portion of the turbo pump is diverted into the first recirculation line fluidly communicating the pump portion of the turbo pump with a low pressure side of the working fluid circuit; and the start pump is deactivated and the second bypass valve is opened and arranged in the second recirculation line fluidly communicating the start pump with the low pressure side of the working fluid circuit.

8. A heat engine system, comprising:

a turbo pump having a pump portion operatively coupled to a drive turbine and hermetically-sealed within a casing, the pump portion being configured to circulate a working fluid throughout a working fluid circuit;

a start pump arranged in series with the pump portion of the turbo pump in the working fluid circuit;

a first check valve arranged in the working fluid circuit downstream of the pump portion;

a second check valve arranged in the working fluid circuit downstream of the start pump and fluidly coupled to the first check valve;

a power turbine fluidly coupled to both the pump portion of the turbo pump and the pump portion of the start pump;

a first recirculation line fluidly coupling the pump portion with the working fluid circuit; and a second recirculation line fluidly coupling the start pump with the working fluid circuit.

9. The heat engine system of claim 8, further comprising:

a first recuperator fluidly coupled to the power turbine.

10. The heat engine system of claim 9 further comprising:

a second recuperator fluidly coupled to the drive turbine.

11. The heat engine system of claim 9, wherein the start pump is positioned between the turbo pump and the first recuperator in the working fluid circuit.

12. The heat engine system of claim 8, wherein:

the first recirculation line is fluidly coupled to the pump portion with a low pressure side of the working fluid circuit; and the second recirculation line is fluidly coupled to the start pump with the low pressure side of the working fluid circuit.

* * * * *